US005595223A

United States Patent [19]

Hayao

[11] Patent Number: 5,595,223

[45] Date of Patent: Jan. 21, 1997

[54] INK REFILLING ASSEMBLY

[75] Inventor: Sakae Hayao, Chatsworth, Calif.

[73] Assignee: Mitsubishi Pencil Corporation of America, Chatsworth, Calif.

[21] Appl. No.: 409,012

[22] Filed: Mar. 23, 1995

Related U.S. Application Data

[63] Continuation-in-part of Ser. No. 327,280, Oct. 21, 1994, abandoned.

[51] Int. Cl.[6] ..... B65B 1/04; B65B 3/00; B67C 3/00

[52] U.S. Cl. ..... 141/375; 141/18; 141/329; 141/330; 141/363; 141/366; 141/369; 222/81; 222/82; 222/88; 347/87

[58] Field of Search ..... 141/18, 21, 312, 141/329, 330, 363–366, 369, 370, 375, 383, 386; 222/81, 82, 88; 347/87

[56] References Cited

U.S. PATENT DOCUMENTS

| | | | |
|---|---|---|---|
| 2,577,045 | 12/1951 | Stout . | |
| 3,364,930 | 1/1968 | Ryan . | |
| 3,764,796 | 10/1973 | Gilliam et al. . | |
| 4,119,128 | 10/1978 | Bishop . | |
| 4,161,178 | 7/1979 | Genese | 141/329 |
| 4,183,684 | 1/1980 | Avery, Jr. . | |
| 4,528,268 | 7/1985 | Andersen et al. . | |
| 4,591,875 | 5/1986 | McCann . | |
| 4,700,202 | 10/1987 | Kiranishi et al. | 346/140 R |
| 4,999,652 | 3/1991 | Chan | 347/87 |
| 5,222,530 | 6/1993 | Baker et al. . | |
| 5,280,300 | 1/1994 | Fong et al. | 347/87 |
| 5,288,159 | 2/1994 | Wirt . | |
| 5,329,294 | 7/1994 | Ontawar et al. . | |
| 5,454,409 | 6/1994 | McAffer et al. | 141/330 |

FOREIGN PATENT DOCUMENTS

| | | | |
|---|---|---|---|
| 0523915A2 | 1/1993 | European Pat. Off. | B67D 5/33 |
| 611659A2 | 8/1994 | European Pat. Off. | B41J 2/175 |
| 0117718 | 9/1994 | European Pat. Off. | B41J 27/00 |
| 59-156756 | 9/1984 | Japan | B41J 3/04 |
| 61-284445 | 12/1986 | Japan | B41J 3/04 |
| WO93/18920 | 9/1993 | WIPO | B41J 2/175 |

*Primary Examiner*—Henry J. Recla
*Assistant Examiner*—Timothy L. Maust
*Attorney, Agent, or Firm*—Koda and Androlia

[57] ABSTRACT

An ink refill adapter to be used for refilling a used ink cartridge with ink from a separate ink container. The ink refill adapter includes a support plate and a conduit extending through the support plate. When the ink refill adapter is placed on the used cartridge, the ink container and the ink cartridge are brought into full engagement via the adapter so that the ink in the ink container flows down by gravity into the conduit and further into the cartridge. The ink refill adapter is designed so as to form an air escape between the adapter and the cartridge so as to let the air inside the cartridge go out smoothly as the ink flows in and is further provided with a safety cap that has an ink absorbing material.

11 Claims, 4 Drawing Sheets

INK REFILLING ASSEMBLY

This is a continuation-In-Part of application Ser. No. 08/327,280, filed Oct. 21, 1994, now abandoned.

BACKGROUND OF THE INVENTION

1. Field of the Invention

This invention relates to an ink refilling assembly or adapter for refilling a used ink cartridge with ink.

2. Prior Art

A variety of ink cartridges have been developed for printers which use liquid ink for printing, such as ink jet printers. Some of the ink cartridges are disposed of once the ink contained in the cartridges has been depleted. Other ink cartridges may be refilled with ink when ink contained in the cartridges has been depleted.

Typically, a refillable ink cartridge has an inlet port which may be closed by a plug or a cap. A syringe with a needle-like injector may be used to transport ink from a separate ink container into the refillable ink cartridge through the inlet port. Alternatively, a separate ink container may include an injection nozzle which is attached to the container so that ink can be directly supplied from the container to the refillable ink cartridge.

These prior art ink refilling injectors suffer some problems. For example, while the ink container is held by the hand of a user, at the same time, pressure must be applied to the ink container to push or squeeze out the ink from the container into the refillable ink cartridge. Such the ink refilling operation is often cumbersome and causes spillage over the refillable ink cartridge and other parts of the ink jet apparatus before the ink refilling operation is even started. Such ink spillage may likely occur during and after the ink refilling operation.

SUMMARY OF THE INVENTION

It is an object of the present invention to provide an ink refilling assembly or ink refill adapter which facilitates the operation of refilling a used, empty ink cartridge with ink.

It is another object of the present invention to provide an ink refilling assembly or adapter which facilitates a cleaner refilling operation.

The objects are accomplished by, in accordance with one embodiment of the present invention, an ink refilling assembly for refilling an ink cartridge with ink from a separate ink container, and the ink refilling assembly is mainly comprised of a covering plate that is snugly placed on an ink cartridge. The cover plate is provided with a conduit defining an upper portion and a lower portion which is opposite from the upper portion so that the conduit penetrates the covering plate. In addition, the covering plate has a protective collar surrounding the upper portion of the conduit, and a cap which has an ink absorbing material in it is put on the protective collar. The ink refilling assembly further has an air room under the covering plate, and the lower portion of the conduit has substantially a D configuration in cross section so as to form an air passage between the conduit and an ink inlet of the ink cartridge.

With the above structure, when the ink refilling assembly is set between the ink container and the ink cartridge in a fully engaged position, the first end and the second end of the conduit extend into the ink container and the ink cartridge, respectively, thus allowing the ink in the ink container to flow from the container into the ink cartridge by gravity. In addition, with an inner space located under the covering plate and the air passage located around the lower portion of the conduit, the air inside the cartridge can escape smoothly from the cartridge as the ink flows down by gravity into the cartridge. Furthermore, with the cap put on the protective collar after the completion of the refilling of the ink, the ink absorbent material in the cap absorbs the ink remaining inside and outside of the conduit, thus preventing the ink from being transferred from the conduit to surrounding areas.

DETAILED DESCRIPTION OF THE INVENTION

Figure 1:
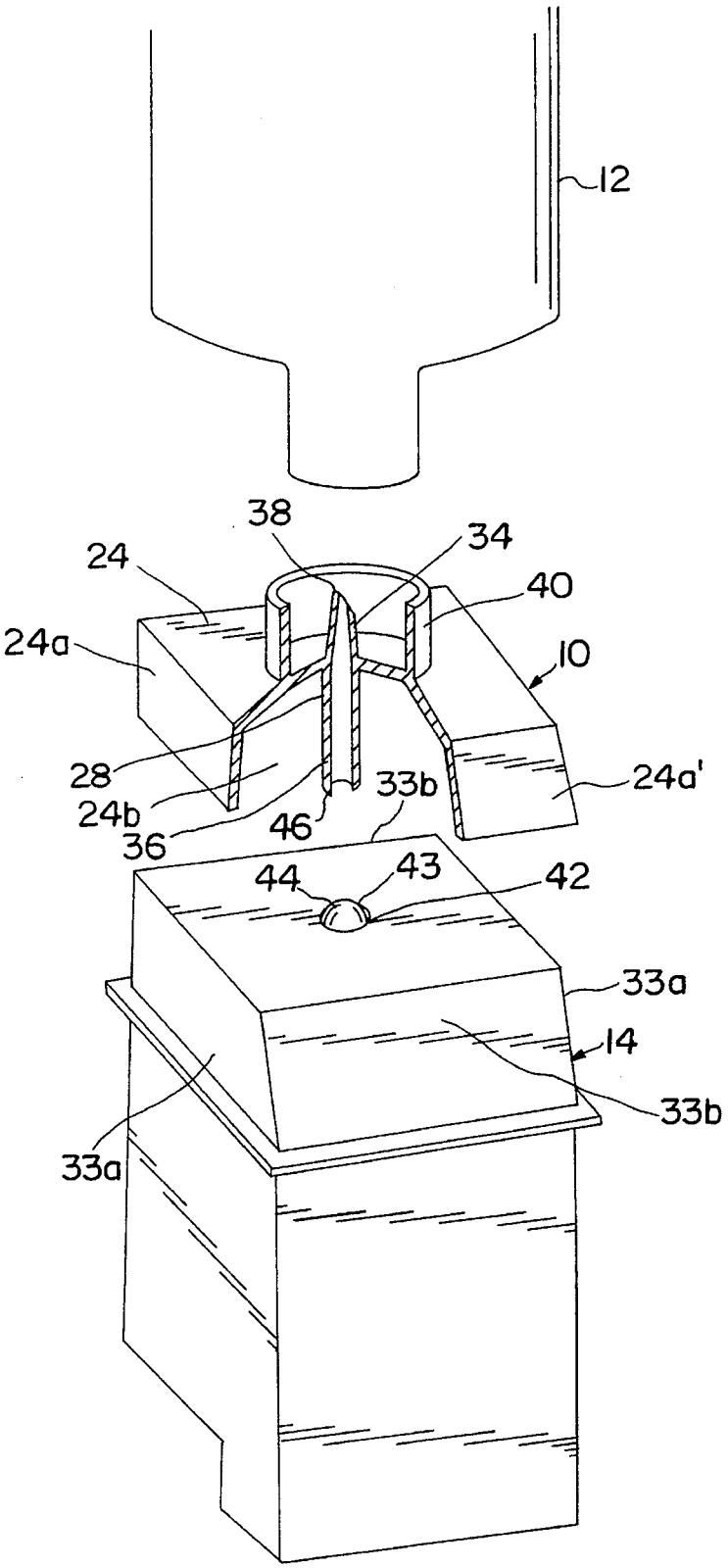
FIG. 1 is a perspective view illustrating an ink refilling assembly (partially broken) in accordance with one embodiment of the present invention with an ink container and an ink cartridge removed from the ink refilling assembly.
Figure 2:
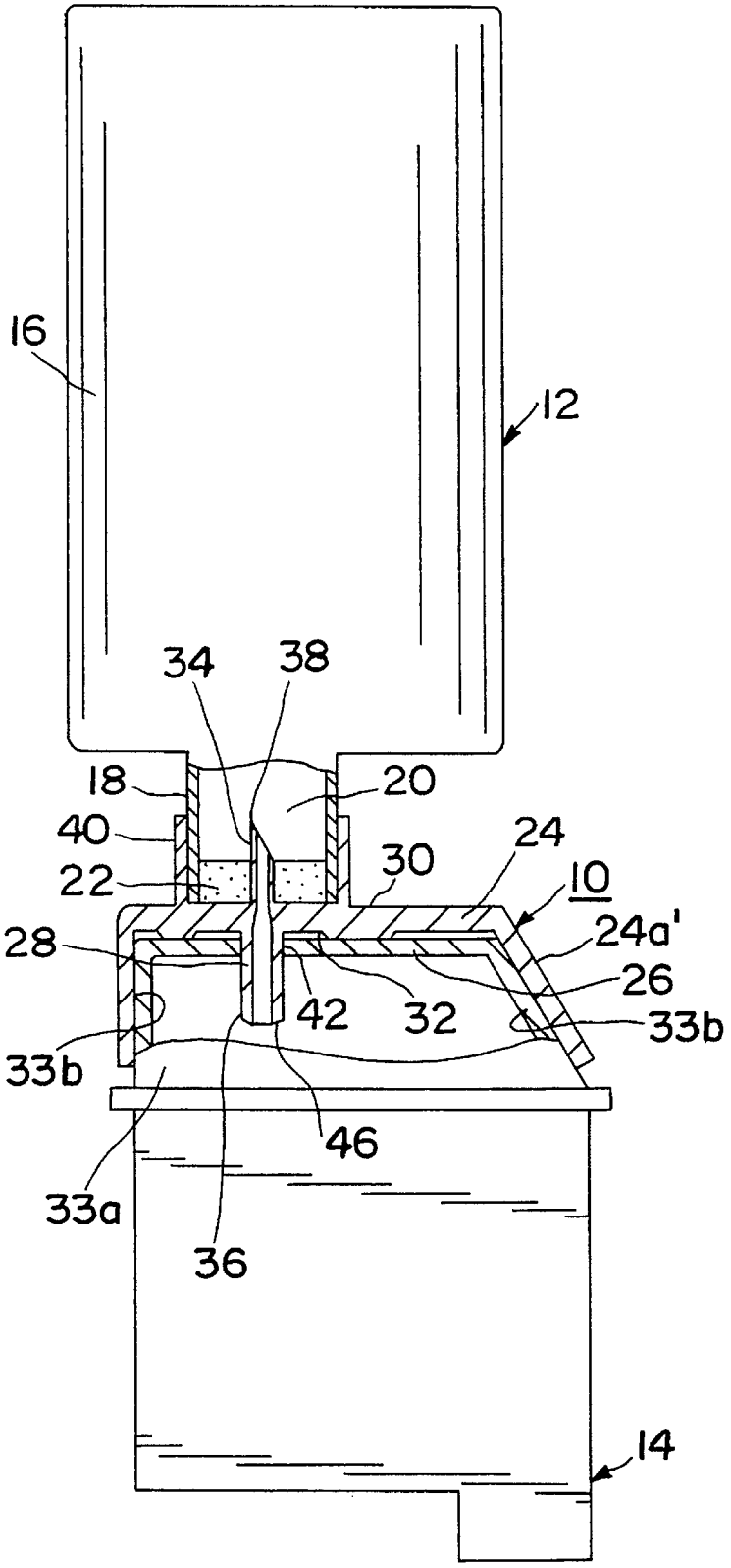
FIG. 2 is a cross sectional view of the ink refilling assembly of FIG. 1 which is fully engaged with an ink container and an ink cartridge.

As shown in FIG. 1 and FIG. 2, the ink refilling assembly or the ink refill adapter in accordance with one embodiment of the present invention is generally indicated at numeral 10. The ink refilling assembly 10 is placed between an ink container 12 and a used, empty ink cartridge 14 and adapted to provide a fluid coupling between the ink container 12 and the ink cartridge 14 through a conduit 28 provided in the refilling assembly 10. When the ink refilling assembly 10 is fully engaged with the ink container 12 and the ink cartridge 14 as shown in FIG. 2, the ink in the ink container 12 flows into the cartridge 14 by its own weight or by gravity.

More specifically, the ink container 12 may be made of a suitable plastic material or a rubber. As shown in FIG. 2, the container 12 may be preferably formed from a bag 16 with a neck portion 18 extending outwardly from the bag 16. Preferably, the bag 16 is made of a relatively soft pliable material, such as aluminum, well-plasticized vinyl resins or soft polyethylene. However, in the present invention the ink flows into the cartridge 14 by gravity and therefore there is no need to squeeze the bag 16. Accordingly, the bag 16 can be made of a hard material too. The neck portion 18 may be made of a relatively hard material regardless of the material of the bag 16 in terms of hardness (or softness). The neck portion 18 of the container 12 defines a central outlet port 20 and includes a plug 22 for closing the outlet port 20. The plug 22 is preferably made of a relatively soft and flexible material, such as rubber or a synthetic rubber.

On the other hand, the ink cartridge 14 to which the ink refilling assembly 10 of the present invention is used has a round ink inlet 42 in the top wall 26. The lower portion of the conduit 28 has a length that extends through the ink inlet 42 of the ink cartridge 14 when the ink refilling assembly 10 is placed on the ink cartridge 14. More specifically, the ink inlet 42 of the cartridge 14 is closed by a ball plug 43 that is snap fitted in the ink inlet 42 but is removed by the lower end of the conduit 28 when the lower end pushes it down.

The ink refilling assembly 10 of the present invention is made of a support plate 24 and the conduit 28 which passes through the support plate 24 at an angle transverse to the support plate 24. The conduit 28 has an upper portion 34 and a lower portion 36.

The support plate 24 generally sits on the top wall 26 of the ink cartridge 14 when the ink refilling assembly 10 is fully engaged with the ink cartridge 14. So as to accomplish such a full engagement, the support plate 24 is shaped so as to conform to the shape of the top wall 26 of the ink cartridge 14 so that it is snugly placed on the cartridge 14.

As seen in FIG. 2, the support plate 24 defines an upper surface 30 which is adapted to come in contact with the neck portion 18 of the ink container 12 and a lower surface 32 which is adapted to be positioned over the top wall 26 of the ink cartridge 14. As noted above, the support plate 24 is in a shape which conforms to the shape of the top wall 26 and upper edges of the side walls 33*a* and 33*b* of the ink cartridge 14. This feature is to stabilize the ink refilling assembly 10 with respect to the ink cartridge 14 during the ink refilling operation.

The support plate 24 has four side walls 24*a*. The side walls 24*a* extend at right angles (except for the one 24*a*' locating front side of the assembly 10) from the edges of the support plate 24 and surround the lower surface 32 of the support plate 24, thus defining an inner space 24*b*.

Figure 3:
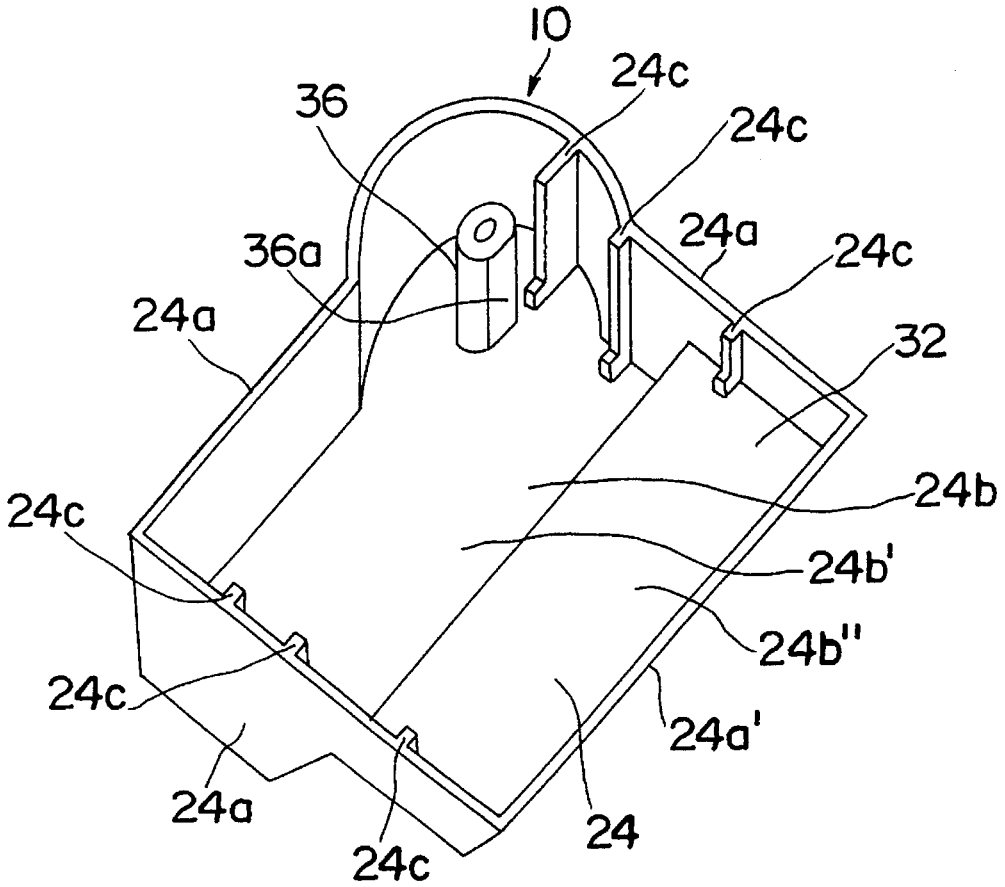
FIG. 3 is a perspective view of the bottom of an ink refilling assembly of another embodiment of the present invention.
Figure 4:
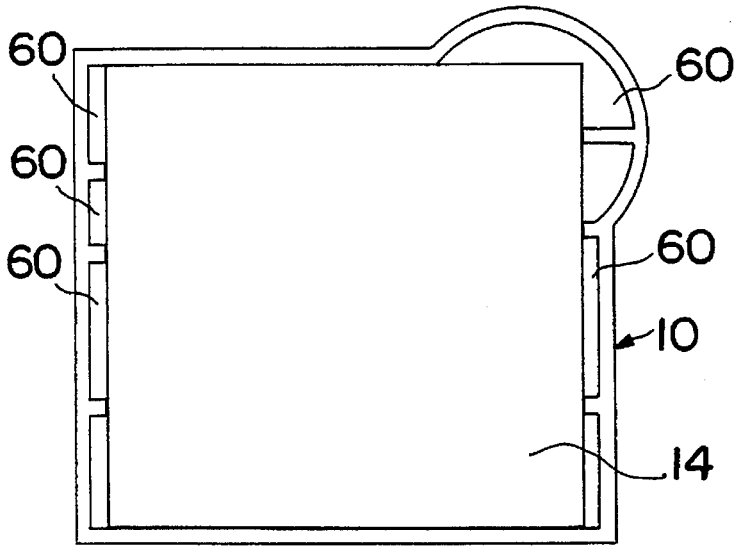
FIG. 4 is a horizontal cross section showing the positional relationship between the ink refilling assembly and the ink cartridge of the embodiment of FIG. 3.

In the embodiment shown in FIG. 3 that has the conduit 28 in the corner of the support plate 24, the side walls 24*a* are provided with a plurality of ribs 24*c* that project inwardly towards the inner space 24*b* from the inner surfaces of the side walls 24a. The ribs 24*b* extend in the direction parallel to the lower portion 36 of the conduit 28. With these ribs 24*c*, air spaces 60 are formed as shown in FIG. 4 between the ink cartridge 14, through which the air can escape from the cartridge 14, and the ink refilling assembly 10 when the ink refilling assembly 10 is placed on the cartridge 14.

Furthermore, in this embodiment, the inner space 24*b* of the ink refilling assembly 10 is divided into two sections: a deeper section 24*b*' and a shallow section 24*b*". The shallow section 24*b*" has a depth in which the lower surface 32 of the support plate 24 that positing corresponds to the shallow section 24*b*" comes into contact with the top surface of the cartridge 14 when the ink refilling assembly 10 is placed on the ink cartridge 14; however, the deep section 24*b*' has a depth in which the lower surface 32 of the support plate 24 that positionally corresponds to the deeper section 24*b*' does not come into contact with and keeps a distance from the top surface of the cartridge 14, thus forming an air room 62 therebetween (see FIG. 6).

The upper portion 34 of the conduit 28 extends from the upper surface 30 of the support plate 24 and the lower portion 36 of the conduit 28 extends from the lower surface 32 of the support plate 24. In the illustrated embodiment, the upper portion 34 of the conduit 28 has a sharp pointed end 38.

The upper portion 34 of the conduit 28 has a sufficient length so that the upper portion 34 penetrates through the plug 22 and the pointed end 38 extends into a reserve of ink in the ink container 12. As described above, the plug 22 is made of a relatively elastic material such as rubber. Therefore, when the upper portion 34 of the conduit 28 penetrates through the plug 22, a hole thus formed in the plug 22 by the upper portion 34 of the conduit 28 is elastically sealed by the elasticity of the plug 22. On the other hand, when the upper portion 34 of the conduit 28 is separated from the plug 22, the hole extending through the plug 22 is sealed by its own elasticity of the plug 22. As a result, substantially no ink spillage occurs during and after the ink refilling operation.

Figure 5:
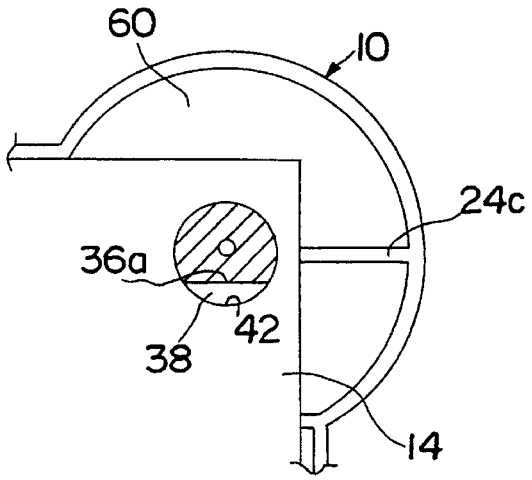
FIG. 5 is an enlarged horizontal cross section particularly showing the positional relationship between the conduit of the ink refilling assembly and the ink inlet of the ink cartridge.

The lower portion 36 of the conduit 28 is round in cross section, but it can be shaped into a D in horizontal cross section as shown in the embodiment of FIG. 3. More specifically, in this embodiment, the lower portion 36 of the conduit 28 has a flat surface 36*a* on the outer circumference. The flat surface 36*a* extends along the axis of the conduit 28 so that the flat surface 36*a* forms the lower portion 36 into a D shaped cross section. With this flat surface 36*a* or D cross section, the conduit 28 forms, as shown in FIG. 5, an air passage 38 between the lower portion 36 of the conduit 28 and the round ink refill hole 42 of the cartridge 14 so that the air passage 38 opens into the air room 62. Thus, the air inside the cartridge 14 can flow out of the cartridge 14 into the air room 62 through the air passage 38 and further to the outside of the ink refilling assembly 10 via the air spaces 60.

The ink refilling assembly 10 further includes a guide collar 40 on the upper surface 30. The guide collar 40 surrounds the upper portion 34 of the conduit 28 with a space in between. The guide collar 40 is slightly higher than the upper portion 34 of the conduit 28. With the thus formed guide collar 40, the neck portion 18 of the container 12 is easily guided towards the support plate 24 and to the conduit 28 and also any injury to fingers of the user can be prohibited. Preferably, the upper portion 34 of the conduit 28 and the guide collar 40 extend at an angle substantially perpendicular to the upper surface 30 of the support plate 24. This arrangement stabilizes and facilitates the penetration of the upper portion 34 of the conduit 28 into the plug 22 of the ink container 12.

Figure 6:
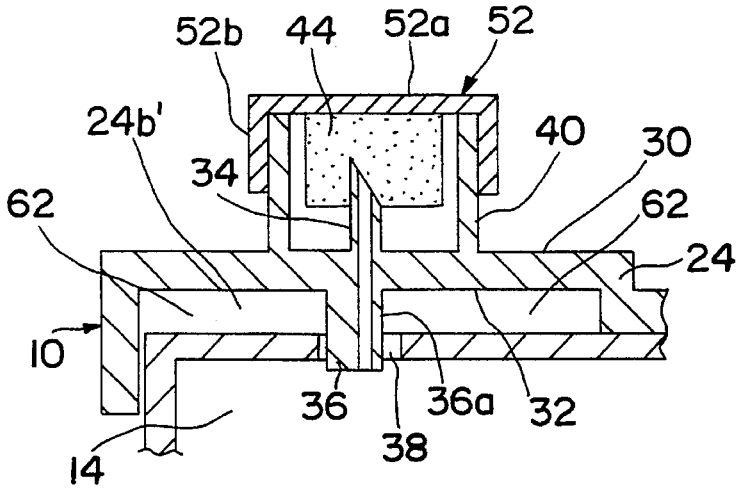
FIG. 6 is an enlarged vertical cross section of the protective collar of the ink refilling assembly with a safety cap thereon.
Figure 7:
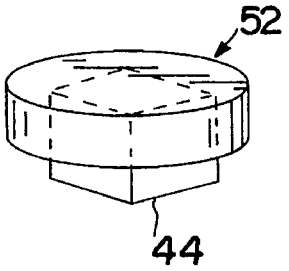
FIG. 7 is a perspective view of the safety cap.

The guide collar 40 can be covered by a safety cap 42 as shown in FIG. 6. The safety cap 52, as seen in FIG. 7, is substantially a flat cylinder having a top 52*a* and a side wall 42*b*. In addition, the cap 52 is provided with an ink absorbing material or ink absorbing means 44 secured to the under surface of the top 52*a*. The ink absorbing material 44 is a cotton, urethane, etc. which is hardened and shaped into, for example, a cubic, cylinder or rectangular form. In other words, the ink absorbing material 44 has a sufficient thickness that can cover the upper portion 34 of the conduit 28. Preferably, the ink absorbing material 44 has a thickness that can cover about the upper half to two thirds of the upper portion 34 of the conduit 28 so that the upper portion 34 can penetrate into the ink absorbent means 44 when the cap 52 is put on the guide collar 40.

In use, the ink refilling assembly 10 with the safety cap 52 thereon is placed on the ink cartridge 14. When the refilling assembly 10 which is shaped so as to conform to the shape of the top wall of the cartridge 14 is thus snugly placed, an extreme end 46 of the lower portion 36 of the conduit 28 comes in contact with the ball plug 43 installed in the ink inlet 42 of the cartridge 14 and pushes the plug 43 down so that the ball plug 43 falls into the ink cartridge 14.

Then, the safety cap 52 is removed from the guide collar 40, and the ink container 12 is set as shown in FIG. 2 with the neck portion 18 inserted inside the guide collar 40. As a result, the ink container 12 communicates with the ink cartridge 14 via the conduit 28.

When the ink container 12 communicates with the ink cartridge 14 through the refilling assembly 10, the ink inside the ink container 12 flows down into the cartridge 14 through the conduit 28 via gravity. As the ink is transferred into the cartridge 14, the air inside the cartridge 14 escapes outside of the cartridge 14 through the air passage 38 that is between the flat surface 36*a* of the lower portion 36 of the conduit and the ink inlet 46. Thus, ink can flow into the cartridge 14 smoothly from the ink container 12. The thus escaped air flows out to the air room 62 and further to outside of the ink refilling assembly 10 through the air spaces 60 that are formed by the gibs 14*a* between the outer surface of the ink cartridge 14 and the inner surfaces of the side walls 24*a* of the ink refilling assembly 10. This further helps the ink to be transferred smoothly from the ink container 12 to the cartridge 14.

After the ink refilling is completed, the ink container 12 is removed from the ink refilling assembly 10 and the ink inlet 52 is closed by another plug 43, such as a plastic plug or rubber plug. In addition, the safety cap 42 is put on the protective collar 40 so that the upper portion 34 of the conduit 18 sticks into the ink absorbing means 44. As a result, the ink remaining inside and outside of the upper portion 34 of the conduit 18 is absorbed by the ink absorbing means 44, thus preventing the ink from touching the desk, sleeve of a shirt of the user, etc. With the safety cap 52 on so that the ink absorbing material 44 covers the pointed end 38 of the conduit 28, any injury to, for instance, fingers of the user can be prevented.

The embodiments described above are to be considered in all respects as illustrative and not restrictive. All changes which come within the meaning and range of equivalency of the invention are to be embraced therein.

I claim:

1. An ink refilling assembly for refilling a removable ink cartridge with ink from a separate ink container through an ink inlet of said ink cartridge, said ink refilling assembly comprising:

a support plate having an upper surface and a lower surface;

side walls extending at right angles from edges of said support plate so as to surround said lower surface and define an inner space for receiving said cartridge;

a cylindrical conduit passing through said support plate at an angle transverse to said top plate, said conduit defining an upper portion and a lower portion which is opposite from said upper portion, said upper portion extending from said upper surface of said support plate for communicating ink from said ink container to said conduit and said lower portion extending from said lower surface of said support plate for communicating ink from said conduit to said ink cartridge; and a plurality of ribs formed on inner surfaces of said side walls so as to project into said inner space and provide air passages for said cartridge while being refilled.

2. An ink refilling assembly according to claim 1, further comprising a protective collar provided on said upper surface of said support plate so as to spacedly surround said upper portion of said conduit.

3. An ink refilling assembly according to claim 2, further comprising a covering means which is put on said protective collar.

4. An ink refilling assembly according to claim 3, wherein said covering means is provided therein with an ink absorbing means.

5. An ink refilling assembly according to claim 4, wherein said ink absorbing means is a hardened cotton.

6. An ink refilling assembly according to claim 4, wherein said ink absorbing means is a hardened urethane.

7. An ink refilling assembly according to claim 1, wherein said lower portion of said conduit is shaped into a D in cross section.

8. An ink refilling assembly according to claim 1, wherein said lower portion of said conduit is provided with a flat surface along a longitudinal axis of said conduit.

9. An ink refilling assembly for refilling an ink cartridge with ink from a separate ink container through an ink inlet of said ink cartridge, said ink refilling assembly comprising:

a support plate having an upper surface and a lower surface;

side walls extending at right angles from edges of said support plate so as to surround said lower surface and define an inner space;

a cylindrical conduit passing through said support plate at an angle transverse to said top plate, said conduit defining an upper portion and a lower portion which is opposite from said upper portion, said upper portion extending from said upper surface of said support plate for communication ink from said ink container to said conduit and said lower portion extending from said lower surface of said support plate for communicating ink from said conduit to said ink cartridge; and a plurality of ribs formed on inner surfaces of said side walls so as to project into said inner space; and wherein said inner space is divided into a shallow section and a deep section, said deep section having a distance from said ink cartridge when said ink refilling assembly is placed on said ink cartridge so as to form an air room between said support plate and said ink cartridge.

10. An ink refilling assembly according to claim 9, wherein said lower portion of said conduit is located in said deep section of said inner space.

11. An ink refilling assembly for refilling an ink cartridge with ink from a separate ink container through an ink inlet of said ink cartridge, said ink refilling assembly comprising:

a support plate having an upper surface and a lower surface;

side walls extending at right angles from edges of said support plate so as to surround said lower surface and define inner space; a cylindrical conduit passing through said support plate at an angle transverse to said top plate, said conduit defining an upper portion and a lower portion which is opposite from said upper portion, said upper portion extending from said upper surface of said support plate for communicating ink from said ink container to said conduit and said lower portion extending from said lower surface of said support plate for communicating ink from said conduit to said ink cartridge; and a plurality of ribs formed on inner surfaces of said side walls so as to project into said inner space; and wherein said lower portion of said conduit is provided with a flat surface on an outer circumference of said second end so as to form an air passage between said flat surface and said ink inlet of said ink cartridge when said ink refilling assembly is placed on said ink cartridge.

* * * * *